United States Patent [19]

Gerber

[11] Patent Number: 4,512,839

[45] Date of Patent: Apr. 23, 1985

[54] MULTI-COLOR SIGN MAKING METHOD AND LAYUP

[75] Inventor: Heinz J. Gerber, West Hartford, Conn.

[73] Assignee: Gerber Scientific, Inc., South Windsor, Conn.

[21] Appl. No.: 437,876

[22] Filed: Oct. 29, 1982

[51] Int. Cl.[3] ..... B26D 7/10

[52] U.S. Cl. ..... 156/248; 156/268; 156/344; 83/29; 83/880; 83/881; 83/71; 101/128.21

[58] Field of Search ..... 83/880, 881, 71, 171, 83/29; 101/127-128.4, 48; 156/268, 344, 248; 33/1 M, 1 CF, 18 R, 18 B; 40/360, 595

[56] References Cited

U.S. PATENT DOCUMENTS

| | | | |
|---|---|---|---|
| 2,527,648 | 10/1950 | Pesci | 156/268 |
| 3,469,488 | 9/1969 | Gaspari | 83/684 |
| 3,555,950 | 1/1971 | Gijsbers | 83/881 |
| 3,826,167 | 7/1974 | Pelet | 83/171 |
| 3,977,310 | 8/1976 | Keck | 83/880 |
| 4,060,168 | 11/1977 | Romagnoli | 156/248 |
| 4,188,250 | 2/1980 | Grass | 156/268 |
| 4,372,070 | 2/1983 | Erlich | 40/595 |

FOREIGN PATENT DOCUMENTS

| | | |
|---|---|---|
| 304515 | 3/1933 | United Kingdom . |
| 389587 | 3/1933 | United Kingdom . |

*Primary Examiner*—James M. Meister
*Assistant Examiner*—John L. Knoble
*Attorney, Agent, or Firm*—McCormick, Paulding & Huber

[57] ABSTRACT

A method of making signs in multiple colors employs an automatically controlled sign making machine and a multi-ply layup of sign material in which the different plies have different colors. The sign making machine has a cutting tool that is moved in the cutting relationship with the layup to cut sign characters defined in the machine memory. The cutting tool is adjustable in depth of cut into the layup so that signs having characters and background of different colors can be prepared.

9 Claims, 5 Drawing Figures

MULTI-COLOR SIGN MAKING METHOD AND LAYUP

BACKGROUND OF THE PRESENT INVENTION

The present invention relates to the field of sign making and is concerned more particularly with the method of making multi-colored signs with a sign making machine.

U.S. Pat. Nos. 3,465,627 and 3,826,167 disclose sign-forming apparatuses which employ dies to cut through a thermoplastic sign material adhesively secured to a paper release material. The apparatus is designed to cut a series of sign characters such as letters or numbers, with appropriate spacing between the characters in accordance with the final positioning of the characters in a sign. The cut characters are then transferred from the release material to a signboard or other display object.

The sign material which is commercially available and used in the die-cutting machines described above is generally a flexible thermoplastic sheet such as a vinyl plastic film having a thickness of 3 to 4 mils with excellent heat, solvent and abrasion resistance. The thermoplastic sheet or film is available in a number of colors, and one brand is sold under the trademark SCOTCHCAL by 3M Corporation of Minneapolis, Minn.

A microprocessor-controlled sign-making machine may also be utilized for cutting characters, logos and other designs in a single ply of the sign material. Such a machine includes keyboards for entry of sign data and control of the machine functions. The characters are cut by means of one of several tools, including a heated stylus or a knife blade, and relative movement of the tool and material to cut the characters is controlled by preprogrammed vector commands that are stored for each character in a font memory such as a PROM. Various fonts of characters may be stored in the microprocessor or can be read from an external memory to generate selected characters.

It is an object of the present invention to disclose a method utilizing a sign making machine as described above or a manual method to cut characters and the like from sign material and make signs in multiple colors. It is a further object of the invention to provide a layup of sign material from which multi-colored signs can be generated in a single cutting operation.

SUMMARY OF THE INVENTION

The present invention resides in a method of making signs in multiple colors and preferably employs an automatically controlled sign making machine which can cut through a new and novel layup of sign material to a controlled depth.

The method is comprised of providing a multi-ply layup of sign material having at least two plies with different colors. One of the surfaces of each ply is covered with a releasable adhesive for securing the plies together in the layup.

The multi-ply layup is then placed in a cutting machine, preferably a program-controlled cutting machine, having an adjustable-depth cutting tool for cutting through selected plies of the layup in a programmed operation. The depth of the cutting tool is adjusted to penetrate through a selected ply of the different colored plies in the layup. The machine is programmed and then actuated to move the cutting tool and the layup relative to one another in a cutting operation to thereby cut the desired sign characters through the selected plies.

Once the characters have been cut in the material, one of more of the plies can be stripped away within or outside of the lines of cut to expose different colors in different portions of the sign. In one form of the invention, either the background may be stripped away or the characters may be stripped away to provide a sign having contrasting characters and background. In another form of the invention, different portions of a single character, such as the border region and the inner regions, may be separated from one another to provide multiple colors in the character itself.

The invention also pertains to the novel layup of sign material which is comprised by multiple plies of the sheet sign material stacked on top of one another with a releasable adhesive joining adjacent plies. When the characters are cut, different portions of the cut plies may be removed from the stack for selective exposure of different colors in a sign.

DESCRIPTION OF THE PREFERRED EMBODIMENTS

Figure 1:
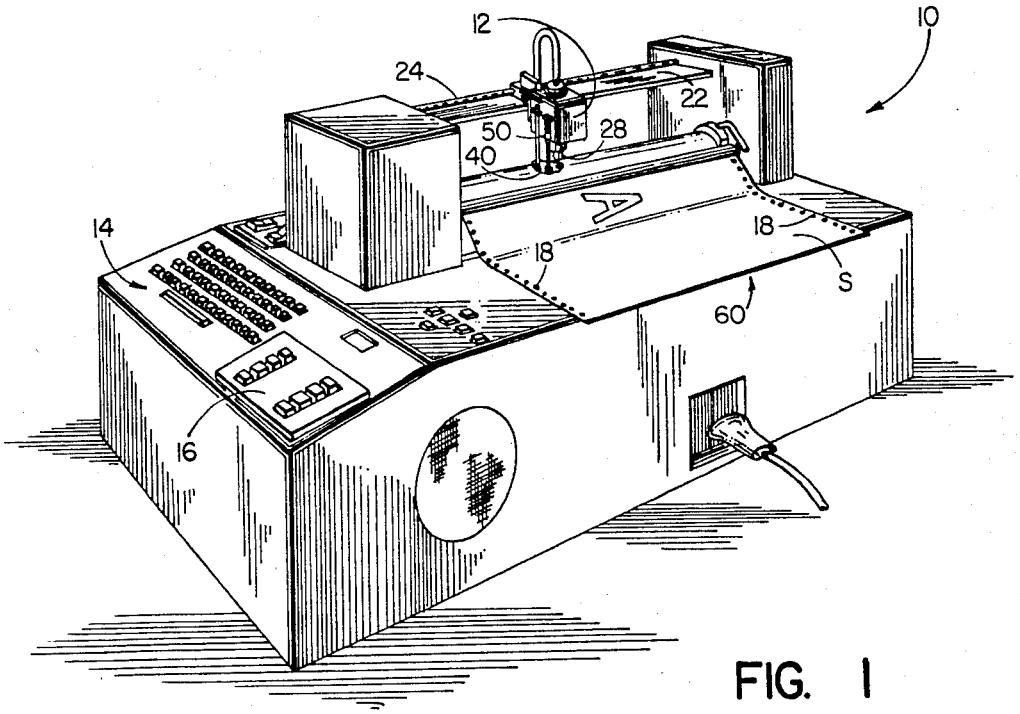
FIG. 1 discloses an automatically controlled sign-making machine for preparing signs in accordance with the method of the present invention.

FIG. 1 illustrates an automatically controlled sign making machine, generally designated 10, for performing sign cutting operations in accordance with one embodiment of the present invention. The machine has a cutting head 12 which is moved back and forth transversely of a strip of thermoplastic sign material S while the sign material is moved longitudinally of itself under the tool head. Controlled movements of the head and the sheet material are produced by a microprocessor-based controller within the machine 10 in response to programmed sign information and commands that are entered through the keyboards 14 and 16. A sign-making apparatus of this type is manufactured by and commercially available from Gerber Scientific Products, Inc. of Manchester, Conn. The machine has one or more fonts of characters stored within and the machine operator can compose the text of the sign through the keyboard 14 in much the same manner as a typewriter. Once a sign is composed, the operator actuates the machine to cut the sign material S by means of the function control keyboard 16.

Figure 2:
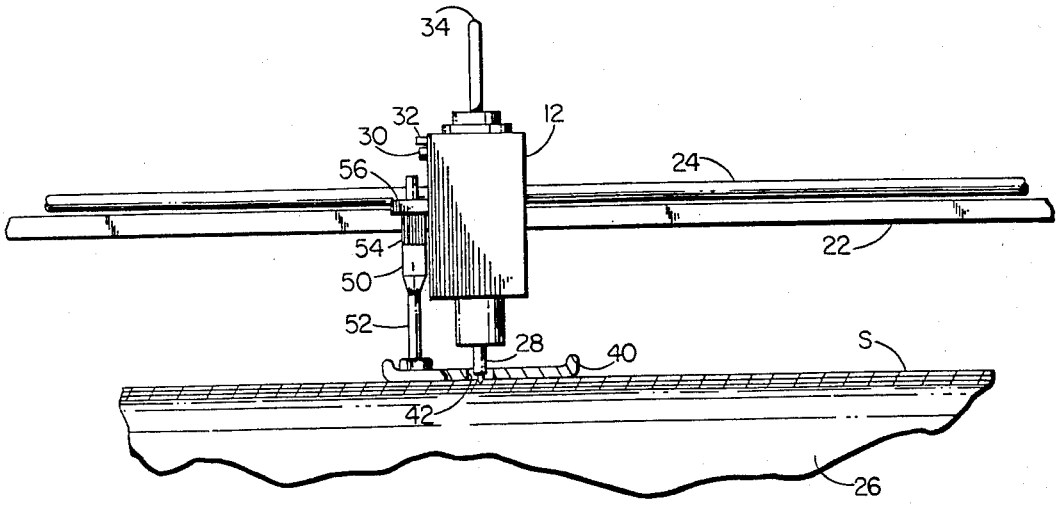
FIG. 2 is a fragmentary side elevation view of the variable-depth cutting tool in the machine of FIG. 1.
Figure 3:
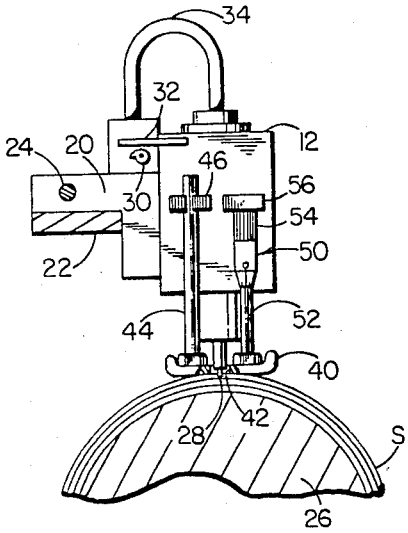
FIG. 3 is a fragmentary front elevation view of the variable-depth cutting tool in the machine of FIG. 1.

FIGS. 2 and 3 illustrate the cutting head 12 of the automatically controlled machine 10 in greater detail. The head 12 is mounted on a carriage 20 which moves on a guideplate or way 22 transversely of the sign material S. A lead screw 24 threadably engages the carriage and is driven rotatably by a controlled drive motor such as stepmotor (not shown) within the machine to accurately position the carriage 20 and the head 12 in the transverse direction.

The head 12 is mounted in cantilever fashion to the front end of the carriage 20 which positions the head directly over a feed roller 26 supporting the sign material for cutting by a tool 28 carried in the head. The feed roller 26 engages the material through sprocket pins and sprocket holes 18 along both longitudinal edges of the material and drives the material longitudinally under the head by means of another controlled drive motor (not shown). Combined movements of the head and material enable two-dimensional sign characters to be cut in the material.

The head 12 is adapted to move relative to the carriage 20 toward and away from the feed roller and to thereby move the cutting tool 28 into and out of cutting engagement with the material. For this purpose a rotatably driven lifting cam 30 on the carriage engages a lifting arm 32 connected to the head, and when the cam is rotated in the clockwise direction from the position illustrated in FIG. 3, the lobe of the cam engages the arm 32, lifts the entire head and raises the tool 28 out of engagement with the material S. When the cam 30 is rotated in the counterclockwise direction to the position illustrated in FIG. 3, the head 12 is lowered and the tool 28 is brought into cutting engagement with the material.

The tool 28 can take several forms including a heated stylus such as shown or a knife blade having a sharp leading cutting edge. The heated stylus receives power through an electrical supply line 34 and melts thermoplastic sign material such as mentioned above along the line of cut produced by relative movements of the head 12 and feed roller 26. Alternatively, a cutting blade may be guided along a line of cut, and the blade may be castered in order to properly align itself in the direction of cut or the orientation of the blade can be controlled by a third drive motor.

To control the depth of cut of the tool 28 through the sign material S, a presser foot 40 is suspended from the head 12 with a central aperture 42 through which the tool projects toward the sign material. The pressure foot is held by means of a guide rod 44 which slides vertically through a lug 46 on the side of the head and by an adjustable micrometer 50. The micrometer has an extendable shaft 52 connected to the presser foot 40 and a knurled thumb knob 54 rotatably secured to a lug 56 on the side of the head. The knob extends or retracts the shaft 52 and correspondingly positions the presser foot 40 relative to the head and cutting tool 28.

The presser foot 40 supports the entire weight of the head 12 on the sign material when the lifting cam 30 lowers the head and cutting tool 28 into engagement with the material. It will be understood that the adjustment of the micrometer 50 determines the amount by which the tool projects through the aperture 42 and correspondingly the depth of cut by the tool into the sign material. By appropriate adjustment of the micrometer, the depth of cut is controlled.

Figure 4:
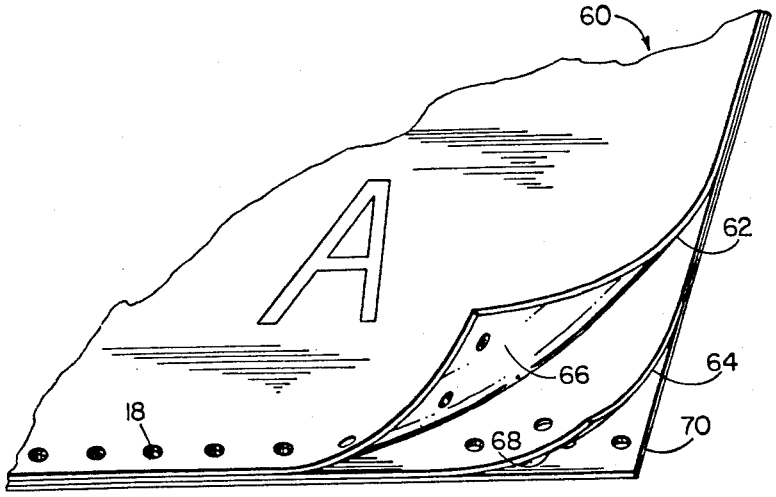
FIG. 4 is a fragmentary perspective view of the novel sign material layup with the corner of several plies lifted for purposes of illustration.

FIG. 4 illustrates a novel layup of sign material that is utilized in the sign-making machine 10 for making signs in multiple colors. The layup 60 is comprised of stacked, multiple plies 62, 64 of a sheet material such as the vinyl sheet utilized in the SCOTCHCAL film referred to above. The plies have a releasable pressure sensitive adhesive on the lower surfaces 66, 68 respectively for securing the plies together in the stack and also for attaching the sign material to a sign board or other display panel in a finished sign. A releasable adhesive of the same type utilized in the SCOTCHCAL film is appropriate for this purpose and permits an upper ply to be lifted as shown and stripped away to reveal a lower ply.

The adhesive on the bottom side 68 of the lowest ply 64 in the layup is covered with a sheet of release material 70 to protect the adhesive and prevent the material from adhering to other objects, including the feed roller 26 during handling and cutting. The release material 70 is comprised, for example, by a heavy-grade paper covered with a silicone coating on the side confronting the adhesive surface 68 of the lowest ply 64.

In order to generate signs in multiple colors, the plies in the layup 60 have upwardly facing color surfaces different in color from at least one of the other plies in the stack. In the layup 60, for example, having only two plies 62, 64, the colors of the upwardly facing surfaces are different, and if the plies are vinyl sheet material, the entire sheet including both the upwardly facing and the downwardly facing surfaces would be the same color. It will be understood that layups having three or more plies of sign material may also be utilized to prepare signs in multiple colors and, as explained in greater detail below, there must be at least one ply for each color desired in a finished sign. Of course, the layup may have more than one ply with the same color provided there is at least one other ply of a different color.

To produce a multi-colored sign, the multi-ply layup 60 is placed in the automatically controlled sign-making machine 10 as shown in FIG. 1. A font stored in memory is selected and a sign text is entered through the keyboards 14 and 16. After the sign text is entered, the operator adjusts the micrometer 50 to allow the cutting tool 28 to penetrate through a selected number of plies of the layup 60, and the machine 10 is actuated to cut the sign in accordance with the sign cutting program of the machine. After cutting, portions of the upper ply are stripped away to expose the lower play 64.

For example, if the letter "A" shown in the layup 60 of FIG. 4 is desired to appear in red on a yellow background and the ply 62 is a red vinyl while the ply 64 is a yellow vinyl, the cutting tool is adjusted to cut through the ply 62 to the ply 64. First the micrometer 50 is set to allow the cutting tool 28 to penetrate into the layup by an amount between 0.004 to 0.005 inches which is slightly more than the thickness of the ply 62. The cutting head is then lowered for cutting under the control of the machine program. The depth of cut is not extremely critical as long as the tool penetrates at least through the ply 62 of red material because if the tool also penetrates partially through the ply 64, the upper ply 62 may be stripped away from the ply 64 without removing the portion of the ply 62 which defines the character or characters that have been cut. The unpenetrated portion of the ply 64 will hold the "A" of ply 62 in place. As a result, red characters cut out of the ply 62 adhere to the yellow ply 64 forming the background material for the sign in finished form.

The background and character colors can be reversed simply by stripping away the cut character in the ply 62. If different characters in three or more colors are desired, a layup having three or more plies is utilized and the different colors may be reached by adjusting the cutting depth of the tool for each color. If multi-color characters in different colors are desired for a sign on another signboard or background, the micrometer 50 is set to cut completely through the layup, and the cut characters are then removed as a joined pair backed with the release material.

Figure 5:
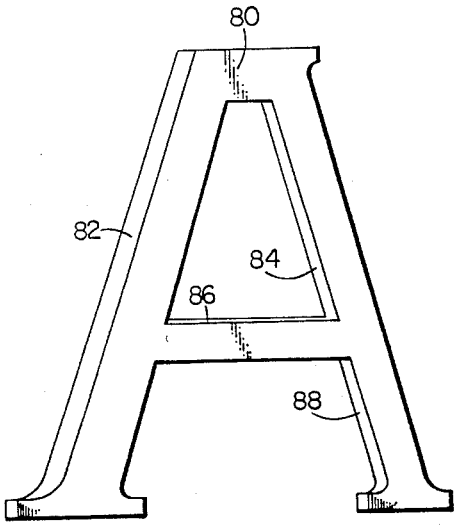
FIG. 5 is a sign character cut from the sign material layup in accordance with the method of the present invention.

Still further, the automatically controlled cutting machine 10 and the layup 60 may be used to make signs with special effects from the multiple colors. FIG. 5 shows the letter "A" cut from the multi-ply layup 60 of FIG. 4 with the main portion 80 of the letter composed of both plies 62, 64 and selected border portions 82, 84, 86, 88 stripped free of the ply 62 to expose the single lower ply 64. Assuming that the ply 62 on top is black and the ply 64 below is yellow, the border portions will cast the letter in a three-dimensional light. Of course, if the layup 60 consisted of more than two colored plies, the stylized character could be resting against a background having still another color.

The cutting of border regions in particular is readily performed in automatically controlled sign-making machines such as shown in FIG. 1 since the cutting tool can be readily offset by varying amounts to cut the border areas along one or both control axes. The offset utilized to cut the portion 82 is a single-axis offset that effectively duplicates the two contours along the left side of the character in spaced relationship. The border areas 84 and 88 are also cut with an offset in the same axis; however, the border area 86 is produced with an offset in the orthogonal control axis.

It is also possible to produce characters in different colors with a constant offset at each or selected sides of the character. Besides the tool offsets, any desired portion of a character or the background may be cut for different colors by programming a desired line or cut where the division between colors is desired. The number of options for varying the configuration and colors of the sign with the multi-ply layup and the process described above of adjusting the cutting depth is unlimited.

While the present invention has been described in several preferred forms, it will be understood that numerous modifications and substitutions can be had without departing from the spirit of the invention. For example, although only two plies 62, 64 having different colors of material are shown in the layup 60 of FIG. 4, a substantially larger number of plies and colors may be included in a single layup. Each color or selected colors in the layup may be exposed in different portions of a sign or sign character by programming the sign-making machine in accordance with the different portions of the machine which bear separate colors. The depth of cut is preferably set to a first depth to cut through one or more plies to the lowest ply having a desired color in the sign, then the tool is set to a second cutting depth less than the first to cut through fewer plies to another color. The process is continued from the lowest ply to the highest ply in the layup. By this means, the integrity of each ply is retained and the cut portions of each ply may then be stripped away from the lower plies without inadvertently also stripping away small slivers, projections or centers of characters. However, if care is exercised while the different layers are stripped adjustment of the cutting depth is not critical and the tool may penetrate through to the lowest ply or to a backing material below that ply. Multi-colored signs can also be made by hand using a scalpel blade. In any case, the upper plies of material when stripped away expose the underlying plies and provide a sign in multiple colors. Accordingly, the present invention has been described in several embodiments by way of illustration rather than limitation.

I claim:

1. A method of making signs in multiple colors comprising:

providing a multi-ply layup of sign material composed of colored plies with at least one ply having one color and another ply having another, different color, a releasable adhesive securing each ply to the other plies in the layup, the bottom colored ply of the layup having a releasable adhesive on the bottom surface for securing the bottom colored ply to another object, and a ply of strippable release material protecting the adhesive on the bottom surface of the bottom colored ply and preventing the layup from adhering before removal of the release material;

placing the multi-ply layup of sign material in a cutting machine having an adjustable depth cutting tool for cutting through selected colored plies of the sign material in the multi-ply layup in a controlled cutting operation;

adjusting the depth of the cutting tool to penetrate through a selected ply other than the bottom colored ply of the layup; and actuating the cutting machine to cut desired sign characters through the selected ply of sign material.

2. A method of making signs in multiple colors as defined in claim 1 wherein the step of adjusting the depth of the cutting tool comprises adjusting the depth of the tool to cut one sign character in one of the plies having one color, and an additional step comprises adjusting the depth of the tool to cut another sign character in the one and another ply having the one and the other colors respectively.

3. A method of making signs in multiple colors as defined in claim 1 wherein the step of placing the multi-ply layup comprises placing the layup in a program-controlled cutting machine having a cutting tool moved relative to the layup in a programmed cutting operation; and an additional step comprises programming the relative movements of the tool and layup prior to actuating the cutting machine in a cutting operation.

4. A method of making signs in multiple colors as defined in claim 3 wherein the steps of adjusting the depth and programming and actuating the cutting machine comprise setting the depth of the tool at a first depth to cut through several plies of different colors to a ply of one color and programming and actuating the cutting machine to cut out selected portions of one character in the layup at the first depth, then setting the depth of the tool at a second depth less than the first depth to cut through fewer plies to a ply of another color, said fewer plies excluding the bottom colored ply, and programming and actuating the cutting machine to cut out other portions of said one character.

5. A method of making signs in multiple colors as defined in claim 4 wherein one of the steps of programming and actuating the cutting machine includes programming the cutting machine to cut border portions from said one character.

6. A method of making signs in multiple colors as defined in claim 1 wherein the step of providing a multi-ply layup comprises providing a multi-ply layup of a thermoplastic sign material having at least two sheets of thermoplastic material of different colors.

7. A method of making signs in multiple colors as defined in claim 1 further including the step of stripping away one part of a cut ply of the sign material to expose the color of an underlying ply.

8. A method of making signs in multiple colors as defined in claim 1 wherein additional steps in the method include stripping the release material to expose the adhesive on the bottom surface, and securing the sign to another object by means of the exposed adhesive.

9. A method of making signs in multiple colors comprising:

providing a layup of sign material having multiple plies stacked one upon the other with a releasable adhesive securing the plies, at least one of the plies in the layup being different in color from another of the plies in the layup, the bottom colored ply of the layup having a releasable adhesive on the bottom surface for securing the bottom colored ply to another object, and a ply of strippable release material protecting the adhesive on the bottom surface of the bottom colored ply and preventing the layup from adhering before removal of the release material;

cutting the layup through at least one colored ply at the top of the layup to another colored ply between the cut ply at the top and the ply of release material at the bottom of the layup, said other colored ply having a color different from said one colored ply; and stripping away a cut portion of the layup to expose said one colored ply at one location, and said other colored ply having the different color at another location to reveal at least two colors and thereby produce a sign in different colors.

* * * * *